US006798338B1

(12) United States Patent
Layton

(10) Patent No.: US 6,798,338 B1
(45) Date of Patent: Sep. 28, 2004

(54) RF COMMUNICATION WITH DOWNHOLE EQUIPMENT

(75) Inventor: James Edward Layton, Chelsea, OK (US)

(73) Assignee: Baker Hughes Incorporated, Houston, TX (US)

( * ) Notice: Subject to any disclaimer, the term of this patent is extended or adjusted under 35 U.S.C. 154(b) by 599 days.

(21) Appl. No.: 09/617,305

(22) Filed: Jul. 17, 2000

Related U.S. Application Data

(63) Continuation-in-part of application No. 09/029,732, filed on Feb. 8, 1999, now Pat. No. 6,167,965.

(51) Int. Cl.[7] ..... H04H 1/11

(52) U.S. Cl. ..... 340/310.01; 166/302; 340/854.6; 340/854.5; 340/855.8

(58) Field of Search ..... 166/302, 105.5, 166/369; 340/854.9, 310.03, 310.07, 310.01, 854.6, 854.5, 855.7, 855.8, 853.7

(56) References Cited

U.S. PATENT DOCUMENTS

| | | | | |
|---|---|---|---|---|
| 2,957,159 | A | 10/1960 | Fitchette | 340/18 |
| 3,950,676 | A | 4/1976 | Dornseifer et al. | |
| 4,157,535 | A | 6/1979 | Balkanli | 340/18 CM |
| 4,188,619 | A | 2/1980 | Perkins | |
| 4,475,209 | A | 10/1984 | Udren | |
| 4,652,855 | A | 3/1987 | Weikel | |
| 4,876,539 | A | 10/1989 | Farque | 340/856 |
| 5,444,184 | A | 8/1995 | Hassel | |
| 5,515,038 | A | 5/1996 | Smith | 340/853.3 |
| 5,539,375 | A | 7/1996 | Atherton | |
| 5,900,179 | A | 5/1999 | Bilenko et al. | |
| 5,945,923 | A | 8/1999 | Soulier | 340/854.6 |
| 5,999,094 | A | 12/1999 | Nilssen | |
| 6,154,488 | A | 11/2000 | Hunt | |
| 6,167,965 | B1 | 1/2001 | Bearden et al. | 166/250.15 |

FOREIGN PATENT DOCUMENTS

| | | |
|---|---|---|
| GB | 2 280 577 A | 2/1995 |
| GB | 2 352 150 A | 1/2001 |
| GB | 2 352 180 A | 1/2001 |
| GB | 2 352 321 A | 1/2001 |
| WO | WO 96/23368 | 8/1996 |
| WO | WO 98/06187 | 2/1998 |
| WO | WO 01/86831 A1 | 11/2001 |

*Primary Examiner*—Michael Horabik
*Assistant Examiner*—Hung Dang

(57) ABSTRACT

Data or control signals are communicated over a three phase power cable supplying power from a surface location to a motor/pump assembly located within a wellbore utilizing modulated radio frequency signals. The radio frequency signals may be impressed on the power cable through physical taps to the power cable conductors or by reactive coupling to the power cable. The transmission frequency is selected from a range of frequencies which propagate through the motor windings and up the power cable with sufficient amplitude to be received and processed. The modulated RF signal may be transmitted concurrently with the three phase power on the power cable, and simultaneous bidirectional communications between the surface and downhole locations may be supported utilizing, for example, discrete frequencies for transmission in different directions. A network of RF transceivers or nodes may be situated at various locations along the wellbore and the motor/pump assembly to gather information about conditions at different points (e.g., below the motor/pump assembly, above the motor/pump assembly, and at the wellhead of a subsea borehole), with transmission on the power cable shared among the nodes through a spread spectrum and/or multiple access protocol.

15 Claims, 1 Drawing Sheet

RF COMMUNICATION WITH DOWNHOLE EQUIPMENT

RELATED APPLICATIONS

The present invention is a continuation-in-part of commonly assigned, U.S. patent application Ser. No. 09/029,732 entitled "AN IMPROVED ELECTRICAL SUBMERSIBLE PUMP AND METHODS FOR ENHANCED UTILIZATION OF ELECTRICAL SUBMERSIBLE PUMPS IN THE COMPLETION AND PRODUCTION OF WELLBORES" and filed Feb. 8, 1999 now U.S. Pat. No. 6,167,965. The content of the above-identified application is incorporated herein by reference.

BACKGROUND OF THE INVENTION

1. Technical Field

The present invention generally relates to data telemetry systems for downhole sensors and other equipment and in particular to data telemetry over power cables. Still more particularly, the present invention relates to employing a modulated radio frequency carrier for data telemetry over power cables.

2. Description of the Related Art

Various data telemetry systems for returning measurements from sensors within a borehole or for transmitting commands to equipment within the borehole have been proposed and/or utilized. Several such systems employ the power cable transmitting three phase power downhole to an electrical submersible pump or other load device for transmitting the telemetry signals. Within these types of systems, generally the signaling arrangement either requires a ground reference for the return path or treats all three power conductor cables as a single conductor.

Systems which require a ground reference usually require an additional conductor for the return path. However, casing and tubing dimensions may not leave enough room for the additional conductor, the additional conductor adds to the cost of the system, and the additional conductor represents an additional point of possible failure for the system.

On the other hand, systems which treat the three phase power cable as a single conductor often cannot tolerate a ground reference—either intentional or inadvertent—within the power system. Thus, for example, if one phase or conductor of the power system should accidentally be shorted to ground, the downhole components which rely on the three-phase power (e.g., the pump) continue to operate while the telemetry system is disabled.

Moreover, systems employing the three phase power system for data telemetry are frequently limited to one receiving/transmitting device downhole, although it would often be useful to obtain data measurements at several locations within the borehole. In particular, data telemetry systems employing the three phase power cable powering a downhole motor and pump are generally positioned above the motor/pump assembly. Such measurements may be of limited value regarding the operation of the pump, which may extend for a significant distance down the borehole from the top of the motor/pump assembly.

In particular, when an electrical submersible pump (ESP) is employed, the motor/pump assembly is often as long as 60–70 feet, and may be as long as 90–100 feet. Measurements taken at the top of such a motor/pump assembly are not necessarily indicative of conditions at the bottom of the assembly. Measurements for a variety of conditions at the bottom of the motor and/or the bottom of the pump may be useful in monitoring or controlling operations, such as intake pressure and temperature, vibration, flow rate, revolutions per minute, winding temperature, discharge pressure and temperature, and "water cut" (oil/water mixture).

It would be desirable, therefore, to provide a telemetry system employing three-phase power conductors for the data signals without requiring a return or ground reference conductor, but fault-tolerant with respect to unintentional grounding of one or two power phases. It would further be advantageous to provide a data telemetry system which allowed the use of multiple receiving and transmitting stations within the borehole.

SUMMARY OF THE INVENTION

Data or control signals are communicated over a three phase power cable supplying power from a surface location to a motor/pump assembly located within a wellbore utilizing modulated radio frequency signals. The radio frequency signals may be impressed on the power cable through physical taps to the power cable conductors or by reactive coupling to the power cable. The transmission frequency is selected from a range of frequencies which propagate through the motor windings and up the power cable with sufficient amplitude to be received and processed. The modulated RF signal may be transmitted concurrently with the three phase power on the power cable, and simultaneous bidirectional communications between the surface and downhole locations may be supported utilizing, for example, discrete frequencies for transmission in different directions. A network of RF transceivers or nodes may be situated at various locations along the wellbore and the motor/pump assembly to gather information about conditions at different points (e.g., below the motor/pump assembly, above the motor/pump assembly, and at the wellhead of a subsea borehole), with transmission on the power cable shared among the nodes through a spread spectrum and/or multiple access protocol.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figures 1, 2:
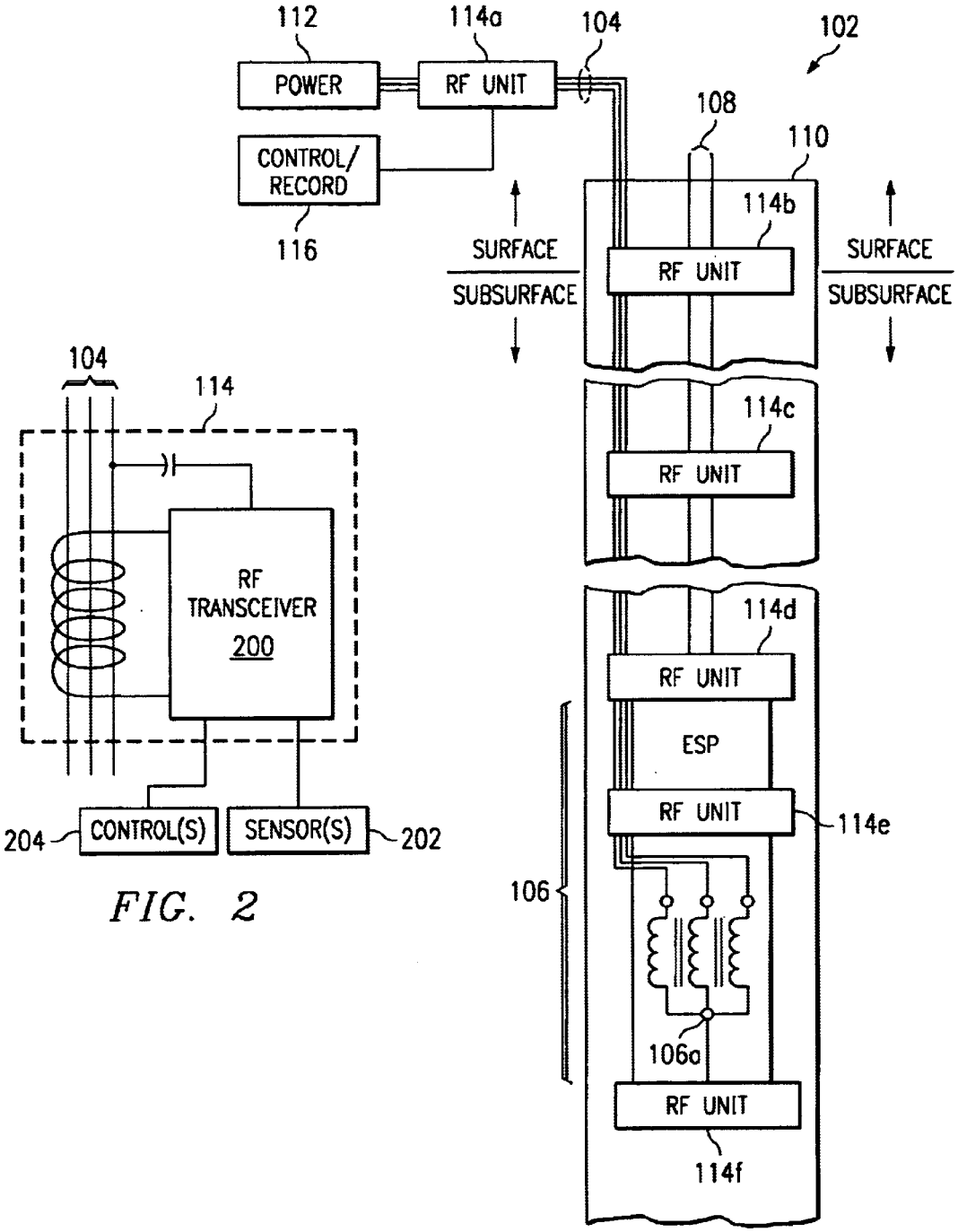
FIG. 1 depicts a data telemetry system in accordance with a preferred embodiment of the present invention.
FIG. 2 is a radio frequency data telemetry unit in accordance with a preferred embodiment of the present invention.

With reference now to the figures, and in particular with reference to FIG. 1, a data telemetry system in accordance with a preferred embodiment of the present invention is depicted. The data telemetry system 102 includes a three phase power cable 104 having separate conductors for each phase. Three phase power cable 104 is connected to a motor and pump assembly 106 adapted for use within a bore hole and disposed within the bore hole by connection to tubing 108 lowered within the casing 110 for a well. Pump and motor assembly 106 may include an electrical submersible pump (ESP), such as the type disclosed in U.S. Pat. No. 5,845,709, coupled to a motor (e.g., an induction motor). The motor drives the pump and is powered by three phase power transmitted over three phase transmission cable 104 electrically coupling pump and motor assembly 106 to a surface power source 112.

Three phase transmission cable 104 transmits three phase power from a surface power system 112. Surface power system may be any suitable three phase power system such as an inverter, a motor or turbine driven generator and/or an alternator producing three phase alternating current of about 380 to 5,000 volts (RMS) at a typical frequency of 30–90 Hz.

Sensors within the bore hole measure selected parameters such as temperature, pressure, and/or flow rate and generate electrical signals representative of the measurements. Additionally, controls for controlling the operation of motor/pump assembly 106 may also be configured to receive control signals from the surface. In the present invention, such measurement and control signals are transmitted over the conductors of three phase power cable 104 in a radio frequency signal. The data and control signal telemetry are performed utilizing radio frequency (RF) units 114*a*–114*f* positioned at various locations along the borehole.

Referring to FIG. 2, a radio frequency data telemetry unit in accordance with a preferred embodiment of the present invention is illustrated. It has been determined that radio frequency (RF) energy will, for selected frequency ranges dependent upon the motor and cable configuration, propagate through a downhole motor and up the power cable with sufficient amplitude to be received and processed. Some frequencies transmit through with more energy than others. Suitable frequencies for a particular motor and cable configurations may be determined experimentally, either through physical tests or through simulations. Frequencies in the range of 1–3 MHZ are believed to be generally suitable for most common ESP motor and cable configurations, although frequencies of as low as 550 KHz or as high as 10 MHZ may also be suitable. The frequency 1.8 MHZ has been successfully used with Centrilift series 562 motors connected to a three phase power cable.

At these frequencies, which propagate through a downhole motor and up the power cable with sufficient amplitude to be detected at the surface, information may be transmitted in both directions between the surface and the equipment within the well by modulating the RF carrier either with continuous linear signals or, preferably, with encoded information. Modulation of frequency, phase, amplitude, or any combination of the three may be employed to transmit information using the RF carrier. Accordingly, frequency modulation (FM), amplitude modulation (AM), frequency shift key (FSK) modulation, phase shift key (PSK) modulation, and other similar forms of modulation may be employed.

Each RF unit 114*a*–114*f* depicted in FIG. 1 preferably includes an RF transceiver 200. For some locations along the borehole, where measurements are taken, an RF transmitter alone may be sufficient. Similarly, an RF receiver alone may be employed at the surface, or at other selected locations (e.g., employing discrete RF transmitters and RF receivers at the motor/pump assembly). Preferably, however, each RF unit includes an RF transceiver 200 capable of both transmission and reception, so that multiple nodes along the borehole may be "addressed" as described below.

RF transceiver 200 operates according to conventional radio frequency transmission and reception technology, except for the specific requirements noted herein. RF receiver 200 may have an independent, internal power source, such as a battery, or may be connected to one or more conductors of the three phase power cable 104 for power. RF transceiver 200 receives and transmits RF signals on power cable 104. RF transceiver 200 may thus be directly connected to power cable 104 through a tap. Such a connection may be preferable at some locations within the borehole, such as at the motor, where a connection may be made to a neutral (Y) point 106*a* (FIG. 1) commonly found in downhole motors. In any location along the borehole or at the motor neutral, however, RF transceiver is preferably reactively coupled to power cable 104 by single or multiple capacitive sleeving around the power conductors and connected via an appropriate inductance so as to series resonate at the carrier frequency.

RF transceiver 200 is connected to one or more sensors 202 measuring desired parameters such as intake pressure and temperature, vibration, flow rate, revolutions per minute, winding temperature, discharge pressure and temperature, and water cut. The parameter measurements are preferably converted to digital representations, which are employed to encode the information, together with any requisite control signals, within the RF signal by modulating the RF carrier. The parameter measurement information and control signals are transmitted through the motor and along the power cable to the surface, where the measurement information and control signals may be extracted from the RF signal received over the power cable by demodulation.

RF transceiver 200 may also be connected to one or more controls 204 controlling operation of the motor and pump assembly. Control signals from a surface control unit may be encoded within the RF carrier signal by modulation and transmitted from the surface downhole along the power cable, and extracted from the RF signal received at the motor/pump assembly by demodulation. Upon detection by controls 204, the commands represented by such control signals (e.g., operating valves or other downhole equipment, or setting data acquisition configuration or downhole transmitter frequency) may be executed.

Referring back to FIG. 1, a network of RF units 114*a*–114*f* may be employed at various locations relative to a wellbore all commonly connected by the three phase power cable 104. A surface RF unit 114*a* located proximate to the power source 112 may be utilized to receive parameter measurements from other units located within the wellbore and to transmit control signals to other units within the wellbore. A second surface unit 114*b* may be located at the wellhead, particularly for subsea wells, where wellhead pressure, temperature, and cut may be measured and transmitted to the control system 116. One or more additional RF units 114*c* may be located at various intervals within the wellbore 110, providing selected measurements useful for controlling pumping operations. An RF unit 114*d* may be situated at the top of the motor/pump assembly 106, with a second RF unit 114*e* located at the connection between the motor and pump, at the seal section of motor/pump assembly 114*f*, and a third RF unit 114*f* situated at the bottom of motor/pump assembly 106.

RF units 114*a*–114*f* may operate bidirectionally, both transmitting and receiving RF signals over power cable 104. Transmission on power cable 104 may be sequentially multiplexed, either by negotiating for access employing a carrier sense multiple access with collision detect (CSMA/CD) algorithm or being allocated a time slice of the available bandwidth employing a time division multiple access (TDMA) protocol.

RF units 114*a*–114*f* may also operate simultaneously, with several units transmitting and receiving at the same time or any unit both transmitting and receiving simultaneously. Two distinct frequencies may be employed, one for transmission from the surface downhole and another for transmission in the opposite direction, with RF units 114*b*–114*f* addressed by the control system 116 through RF unit 114*a* and activated in response to an assigned code. Each RF unit 114*a*–114*f* may alternatively be assigned a separate frequency to allow simultaneous bidirectional communication, with each downhole RF unit 114*b*–114*f* employing one or more discrete frequencies for transmission and reception and only the RF unit 114*a* connected to the control system 116 receiving and transmitting on all of those frequencies. Alternatively, spread spectrum technologies employing a code division multiple access (CDMA) protocol or frequency hopping may be utilized to enable simultaneous bidirectional communication between the surface RF unit 114*a* and other nodes 114*b*–114*f* along the power cable 104.

With the present invention, no return ground conductor is required, although one or more phases of power cable 104 may be grounded—either intentionally or inadvertently—and communications between the surface and downhole locations may be maintained. Additionally, communications over the power cable are possible while the motor/pump assembly are being lowered downhole. Information may be transmitted through the motor windings from the bottom of the motor/pump assembly and propagate up the power cable to the surface.

While the invention has been particularly shown and described with reference to a preferred embodiment, it will be understood by those skilled in the art that various changes in form and detail may be made therein without departing from the spirit and scope of the invention.

What is claimed is:

1. A method of communication over a three phase power cable, comprising:

transmitting power over a three phase power cable connecting surface equipment to downhole components within a borehole;

transmitting a radio frequency signal over all three phases of the power cable concurrently with the power and through a pump motor; and decoupling the radio frequency signal from the power received over the power cable and through the pump motor.

2. The method of claim 1, further comprising:

modulating at least one of a frequency, a phase, an amplitude, or a combination of frequency, phase, and amplitude of the radio frequency signal to encode information within the radio frequency signal.

3. A system for communication over a power cable, comprising:

a three phase power cable transmitting power from surface equipment to downhole components;

a transmitter transmitting a radio frequency signal over all three phases of the power cable concurrently with the power; and a receiver decoupling the radio frequency signal received over the power cable and through the pump motor from the power, wherein the downhole components include a motor disposed between the transmitter and the receiver and the radio frequency signal is transmitted from the transmitter through the motor and over the power cable to the receiver.

4. The system of claim 3, wherein the three phase power cable transmits both power for the motor and power for instrumentation within the downhole components.

5. The system of claim 4, wherein the radio frequency signal includes the power for the instrumentation within the downhole components.

6. The system of claim 3, wherein the surface equipment includes a radio frequency transceiver which may function as either the transmitter or the receiver and the downhole components include a radio frequency transceiver which may function as either the transmitter or the receiver.

7. A method of communication over a three phase power cable, comprising:

transmitting power to a motor within a borehole over a three phase power cable connecting surface equipment to downhole components within the borehole, wherein the downhole components include the motor; and transmitting radio frequency signals between the surface equipment and the downhole components by transmission over the power cable and through windings forming the motor.

8. The method of claim 7 wherein the step of transmitting radio frequency signals through windings forming the motor further comprises:

transmitting signals from the downhole components to the surface equipment through the motor; and transmitting signals from the surface equipment to the downhole components through the motor.

9. The method of claim 7, further comprising:

transmitting radio frequency signals on all three phases of the three phase power cable.

10. A system for communicating over a three phase power cable, comprising:

a motor disposed within a borehole; and a three phase power cable connecting surface equipment to downhole components within the borehole and carrying power to the motor, wherein the downhole components include the motor, wherein signals are transmitted between the surface equipment and the downhole components by transmission over the power cable and through the motor.

11. The system of claim 10 wherein the signals transmitted between the surface equipment and the downhole components over the power cable and through the motor are radio frequency signals transmitted through windings forming the motor.

12. The system of claim 11 wherein the radio frequency signals transmitted through the windings forming the motor are transmitted from the downhole components to the surface equipment through the motor and from the surface equipment to the downhole components through the motor.

13. The system of claim 10 wherein the signals transmitted between the surface equipment and the downhole components are transmitted over all three phases of the three phase cable.

14. The system of claim 10 wherein signals are transmitted over the power cable between the surface equipment and a plurality of transceivers located within the borehole.

15. A method of communicating over a three phase power cable, comprising:

supplying power to a motor and pump disposed within a borehole over a three phase power cable connecting surface equipment to the motor and pump; and transmitting signals over the three phase power cable concurrently with the power among a plurality of transceivers coupled to the three phase power cable by transmitting radio frequency signals through windings forming the motor and over the three phase power cable, wherein the plurality of transceivers includes a first transceiver within the surface equipment, a second transceiver within the borehole proximate to the motor and pump, and a third transceiver within the borehole.

* * * * *